2/11/86 4,569,733

United States Patent [19]

Pinkhasov

[11] Patent Number: 4,569,733

[45] Date of Patent: Feb. 11, 1986

[54] METHOD OF TREATING ROCK TO RECOVER METAL, OXYGEN, AND WATER

[75] Inventor: Eduard Pinkhasov, Mt. Vernon, N.Y.

[73] Assignee: Wedtech Corp., Bronx, N.Y.

[21] Appl. No.: 633,126

[22] Filed: Jul. 20, 1984

[51] Int. Cl.[4] ..... C25B 1/02; C25C 5/04

[52] U.S. Cl. ..... 204/60; 204/61; 204/62; 373/2; 373/62; 373/63; 373/3

[58] Field of Search ..... 373/60-63, 373/2-3, 5; 204/60, 61, 64 R

[56] References Cited

U.S. PATENT DOCUMENTS 2,496,623 2/1950 Fragale ..... 123/DIG. 12

3,021,268 2/1962 Egami ..... 204/61

3,405,043 10/1968 Barakat et al. ..... 204/60

OTHER PUBLICATIONS

"Electrowinning of $O_2$ from Silicate Rocks" by D. G. Kesterke, Bur. Mines R.I. 7587, 1971, pp. 1-12.

"General Chemistry" by H. H. Sisler et al., 1949, pp. 231-232.

*Primary Examiner*—R. L. Andrews

*Attorney, Agent, or Firm*—Karl F. Ross; Herbert Dubno

[57] ABSTRACT

Rock is melted between electrodes and the resulting melt is subjected to electrolysis to recover oxygen and selected metals therefrom and to produce a melt of a unique composition so that it can be cast to produce structures with various properties.

14 Claims, 2 Drawing Figures

METHOD OF TREATING ROCK TO RECOVER METAL, OXYGEN, AND WATER

FIELD OF THE INVENTION

My present invention relates to a method for treating rock and, more particularly, to a method of commonly available alumino silicate mineral matter in its virgin form, i.e. without pretreatment other than possible comminution thereof and frequently without such comminution, to put the rock to use as a structural material or to recover components from the rock as necessity may dictate, or for the production of water in areas in which water may not be available or may be scarce. More particularly, this invention relates to a method of treating rock for the production of oxygen and water, for the recovery of metals from the rock, for the production of new crystalline structures from the rock material, and for the production of structural objects.

BACKGROUND OF THE INVENTION

It is known that mineral matter contains metals which may be desirable and indeed the history of mankind has been a history of metallurgical processing, whereby various metals have been extracted from ores and the like. Man has also recognized that rock in its various forms may be utilized as a structural material and indeed as one of the first structural materials having been quarried or otherwise recovered from rock strata, shaped to the configuration desired and placed.

Up to now, however, if local rock was considered an advantageous material and could not economically be shaped as a solid object, the available alternatives for its use included incorporating the rock as an aggregate in a binder in the formation of concrete or the like.

The term "rock" is here used in its most common sense to refer to a material as extracted from an ore, which has not hitherto been generally viewed as a source of the components thereof. The term is thus used to denote stone and a material which consists of two or more minerals, generally with some substantial representation of silica or alumina, or both.

In various areas metal ores are not readily available, i.e. the metal is generally not a predominant component of the rock.

Furthermore, areas in which oxygen and water may be a necessity and also are not readily available exist and there have been some efforts to attempt to recover, for example, water from rock by intensive heating steps.

OBJECTS OF THE INVENTION

It is the principal object of the present invention to provide a method of treating rock which allows the recovery of oxygen, water and even metals and which can be utilized for the production of a product having use as a structural material.

Another object of this invention is to provide a method of treating rock which maximizes the use of rock as a raw material and which may solve material shortages.

SUMMARY OF THE INVENTION

I have now found, quite surprisingly, that when rock is melted between a pair of electrodes and electrolyzed, it is possible to generate a number of materials which are invaluable and that it is possible to do so in a highly economical way, especially where other raw materials for such substances are not readily available, e.g. in lunar applications or processes wherever energy is available in sufficient quantity but other raw materials cannot practically be transported to the site with ease.

For example, the method of the invention can result in molten rock which, according to the invention, is cast to produce shaped objects therefrom with unique properties, since, as the following discussion will show, the composition of the solidified product can differ substantially from the composition of the rock originally used so that new crystallographic configurations of the product are obtained.

The cast material which results may be of greater strength and have other improved properties over concrete and is particularly advantageous because it does not require the addition of water or a hydraulic binder to produce a hard, stable product.

Utilizing the principles of the invention to obtain novel crystallographic configurations, I am able to modify the properties of the rock structures so that translucency and transparency may be imparted to the restructured material as well.

Since an electrolysis is effected, according to the invention, at the negative electrode from ordinary rock, which almost invariably contains oxides of at least one element, I have found that it is possible to recover oxygen and hence an important step of the present invention is the recovery of oxygen directly or the conversion of oxygen as it is formed to water vapor by reaction with a hydrogen atmosphere which may be supplied. The oxygen can be drawn off and collected by absorptive processes for reuse and the water as well can be condensed and collected.

During the electrolysis process it is also possible to collect metal from the bath of molten rock and indeed to selectively recover metals therefrom, the selectivity being effected by appropriate choice of the voltage and/or current utilized for the electrolysis process.

According to another feature of the invention, the electrodes and the mass of the rock are selectively displaced to transform the rock progressively, i.e. the rock being melted and electrolyzed as the electrodes and the rock are relatively displaced with parts of the rock rearwardly of the electrodes with respect to the direction of advance thereof resolidifying or solidifying in new structural configurations. The rock mass can be in situ, i.e. in the original location of the rock or the crust of the heavenly body in which the rock was generated, or the relative displacement can be effected by mechanically moving the mass of rock or removing it from the aforementioned site.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
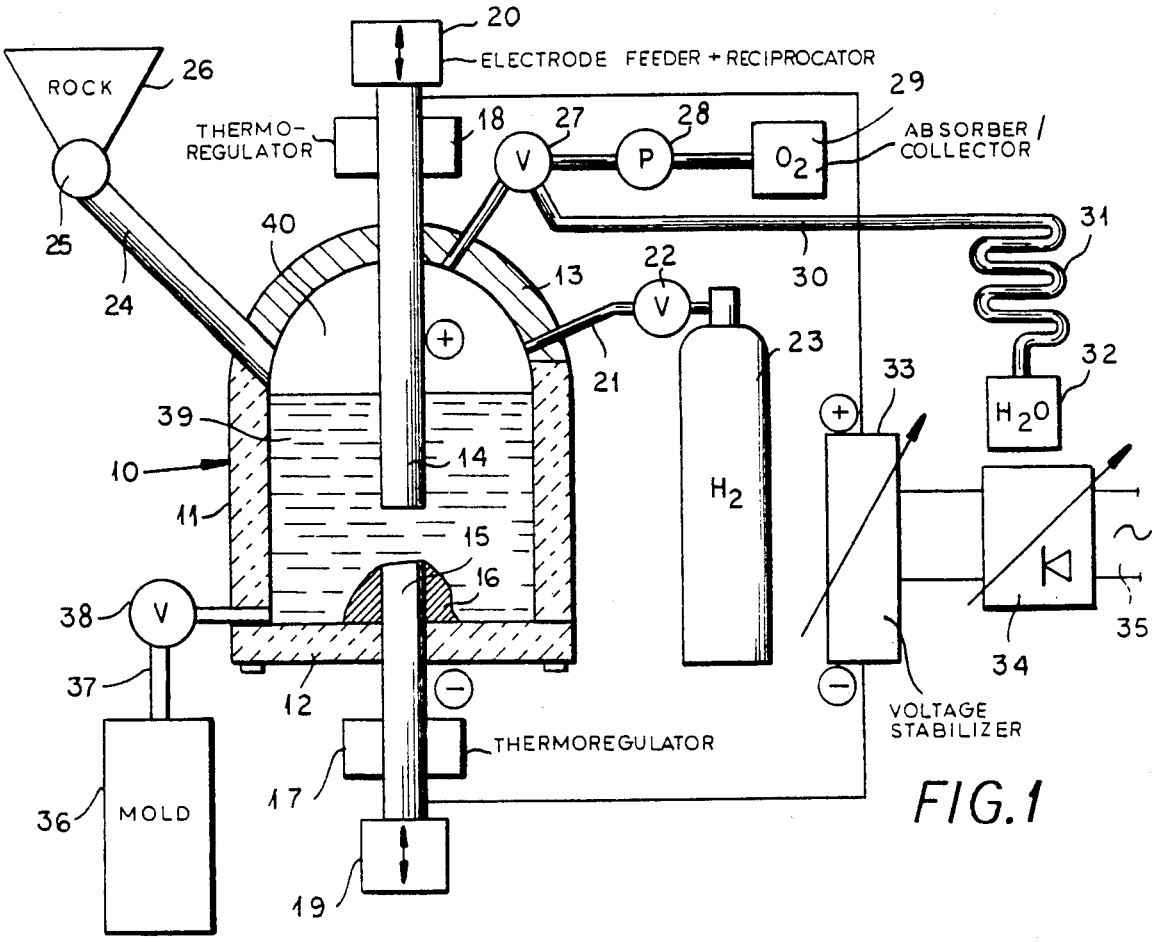
FIG. 1 is a vertical section through a rock-melting apparatus according to the invention, diagrammatically illustrating the mass in various aspects therein.

The present invention utilizes a pair of electrodes for the melting of rock and, since such use of electrodes may be analogous to uses described by me earlier for the different purposes, reference may be had to the copending applications Ser. No. 618,192 filed 7 June 1984, Ser. No. 614,434 filed 25 May 1984 , (now U.S. Pat. No. 4,505,948, both of which were copending with the application Ser. No. 494,302 filed 13 May 1983 as a continuation-in-part of Ser. No. 358,186 filed 15 Mar. 1982 (U.S. Pat. No. 4,438,153). That application was in turn a continuation-in-part of Ser. No. 237,670 filed 24 Feb. 1981 (now U.S. Pat. No. 4,351,855).

Referring now to FIG. 1, it may be noted that the melting of rock according to the invention can be effected in a melting vessel 10 which may be provided with thermally insulating walls and can be composed of separable parts such as the cylinder 11, the floor 12 and the cover 13. The separability of the bottom 12 from the cylinder 11 allows recovery of the electrolytically deposited metal as will be described.

Electrolysis and melting is effected between a pair of electrodes 14 and 15, one of which is negatively poled while the other is positively poled.

The electrodes may be fed and positioned via electrode feeders and reciprocating units 19 and 20 and the temperatures of the electrodes may be controlled by thermoregulators 17 and 18 which can cool the electrodes once the melting has commenced and may preheat the electrode prior to melting. According to the invention, the electrodes can be touched together and drawn apart to create an arc in the mass of rock and initiate arc melting of the rock. Once the melt is formed, electrolysis resistance heating current is passed through the melt to electrolyze the latter and maintain the rock in a molten state.

A valve 38 constitutes a means for tapping molten rock from the bath 39, the molten rock being discharged through a downcomer 37 into a mold 36 which can define a structural shape, e.g. the shape of a beam or slab into which the molten rock is cast and cooled to solidify it and to produce a structural element.

Depending upon the oxygen and metal extracted from the rock and the heating and cooling parameters, the mineral body which is thereby produced may have uniquely different crystal structure from that of the rock which was used to form the melt.

The melt level can be maintained by the feeding of crushed rock from a hopper 26 through a tube 24 into the vessel. The metering device for this purpose has been represented at 25.

The cover 13 above the melt represents a hood for recovery of the gases released by electrolysis and heating from the arc into the space 40 above the melt 39. These gases can include, depending upon the composition of the rock, substances such as carbon dioxide and water vapor which are recovered by drawing them off through the valve 27 to a condensor 31 and a collector 32.

When electrolysis is carried out according to the invention on a rock melt containing oxygen, oxygen comes out of solution at the positive electrode and is collected in the chamber 40. The oxygen can be drawn off through the valve 27 by a pump 28 and collected at 29 in an absorber or adsorber or other collector represented at 29.

When water is the more important product, hydrogen may be admitted to the chamber 40 from a flask 23 via a valve 22 and a pipe 21 for reaction with the evolved oxygen, the water being carried off by line 30 for condensation in the manner described.

For the purposes of the present invention it is important to utilize a direct current for electrolysis and heating of the melt and this direct current can be generated from available alternating current 35 via a rectifier 34 or by some solar energy source of conventional design. The voltage is applied to the electrodes 14 and 15 via a voltage stabilizer 33.

In operation, after assembly of the vessel, ordinary rock which can contain various amounts of selected metal, the recovery of which may be desirable, is partially filled into the vessel. The electrodes may initially be in contact and, as they are drawn apart, an arc can be struck to utilize the arc heating to melt the rock. Once the melt is formed, it tends to dissolve the balance of the rock in the vessel and as the rock is tapped from the vessel into the mold 36, additional rock can be added. During this operation, the current traversing the rock must be sufficient to generate resistively or by ohmic heating, the energy necessary to maintain the rock in a molten state.

If oxygen is to be generated, the direct current voltage can be set at a level above the oxygen overheating so that oxygen is produced at the positive electrode 14. When the hydrogen atmosphere is supplied, the evolved oxygen tends to react rapidly with the hydrogen above the molten rock to produce water vapor.

Since the discharge of oxygen and other gases and the electrolytic deposition of metal in the deposit 16 alters the composition of the melt from that of the arc which was introduced, the product solidified in the mold 36 will have a substantial different crystallographic structure than that of the original arc.

SPECIFIC EXAMPLE

Utilizing the system illustrated in FIG. 1, rock was melted and electrolyzed to produce oxygen and recover traces of copper contained in the rock at the negative electrode. The copper containing silica/alumina rock was melted initially by an arc at 70 amperes and electrolysis was continued after melting at 30 amperes. The oxygen recovery or electrolysis was greater than 50% yield (percentage of theoretical recovery based in the number of Faraday or Coulombs). The space 40 was evacuated at $10^{-1}$ to $10^{-3}$ Torr.

Figure 2:
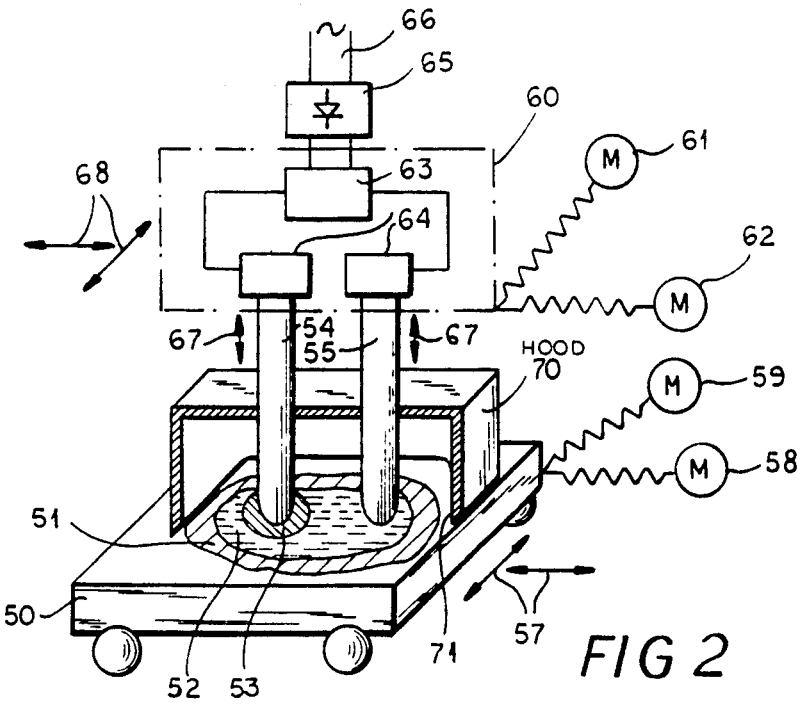
FIG. 2 is a partially perspective and partially sectional diagram illustrating another aspect of this invention.

In FIG. 2 I have illustrated diagrammatically another system which can be utilized. This system comprises a pair of electrodes 54, 55 carried by respective electrode-positioning units 64 in a head 60 which can be moved in two mutually perpendicular directions as represented by the arrow 60 by meters 61 and 62 to displace the electrode in a predetermined pattern along the ground which can consist of irregular rock. When the arc-melting electrodes are then applied via a power supply including the voltage stabilizer 63, the rectifier 65 and the alternating current source 66, the rock is progressively melted along the path which can be selected by a numerical controller or computer. Behind the electrodes with respect to this invention, the rock resolidifies after electrolytic charge in the manner descussed to form a monolithic foundation in situ upon which a structure can be erected.

Alternatively a slab 50 of rock can be mounted on a carriage represented by rollers 56 and can be given a displacement in two mutually perpendicular horizontal directions (arrow 57) by meters 58 and 59 to generate a pattern of movement of the tips of the electrodes 54 and 55 which have been lowered into and have melted a portion of the rock. The molten portion of the rock is shown at 52 and resolidified portions have been shown at 51. Metal is electrolytically deposited on the negative electrode as has been indicated at 53 and the holders 64 can raise and lower the electrodes as represented by the arrow 67 to control the depth of immersion of the electrodes in the melt 52 of the slab.

A hood 70 can be provided for movement with the electrodes and the head 60 so that oxygen or water vapor can be drawn off in the manner discussed, the hood having a seal 71 displaceable along and engageable with the slab by its lower sealing edge. The metal 53 which is electrolytically deposited can be liberated by breaking away the slab if the metal recovery is of paramount importance or can remain as a deposit on the positive electrode. In both embodiments I have found that it is possible to select the metal which is deposited from a number of metals which may be contained in various quantities in the arc to be treated by adjusting the voltage and the current accordingly.

I claim:

1. A method of treating rock which comprise the steps of:

melting a mass of rock containing a number of materials including at least some metal oxides by initially striking an arc by bringing a pair of electrodes into contact and then separating said electrodes while passing an electric current therebetween to form a melt of the rock, and progressively separating said electrodes while continuing to pass electric current between them to increase and sustain the melting of the rock by resistive heating resulting from the passage of electric current through the melt previously formed; and electrolyzing said melt by polarizing one of said electrodes electrolytically positive and polarizing the other of said electrodes relatively negative.

2. The method defined in claim 1, further comprising the step of recovering oxygen at the positively poled electrode.

3. The method defined in claim 1, further comprising the step of maintaining a hydrogen atmosphere above the melt to induce a reaction between electrolytically produced oxygen and the hydrogen of said atmosphere to form water, and collecting the water thus formed.

4. The method defined in claim 1, further comprising the step of recovering a metal at the negatively poled electrode.

5. The method defined in claim 4, further comprising the step of selecting the metal deposited at said negatively poled electrode by controlling voltage and current applied to and through said electrodes.

6. The method defined in claim 1, further comprising the step of casting a shaped body from said melt.

7. The method defined in claim 1, further comprising the step of solidifying said melt to a crystal structure different than that of the original rock.

8. The method defined in claim 7, further comprising the step of relatively displacing said electrodes and said mass of rock whereby said mass is progressively melted and resolidified.

9. The method defined in claim 8 wherein said mass of rock is a slab.

10. A method of treating rock which comprises the steps of:

melting a mass of rock containing a number of materials including at least some metal oxides by initially striking an arc by bringing a pair of electrodes into contact and then separating said electrode while passing an electric current therebetween to form a melt of the rock, and progressively separating said electrodes while continuing to pass electric current between them to increase and sustain the melting of the rock by resistive heating resulting from the passage of electric current through the melt previously formed;

electrolyzing said melt by polarizing one of said electrodes electrolytically positive and polarizing the other of said electrodes relatively negative; and resolidifying said melt into a predetermined structural shape and with a composition different from that of the original rock.

11. The method defined in claim 10, further comprising the step of recovering oxygen at the positively poled electrode.

12. The method defined in claim 10, further comprising the step of maintaining a hydrogen atmosphere above the melt to induce a reaction between electrolytically produced oxygen and the hydrogen of said atmosphere is from water, and collecting the water thus formed.

13. The method defined in claim 10, further comprising the step of recovering a metal at the negatively poled electrode.

14. The method defined in claim 10, further comprising the step of selecting the metal deposited at said negatively poled electrode by controlling voltage and current applied to and through said electrodes.

* * * * *